US009417592B2

(12) United States Patent
Kondo et al.

(10) Patent No.: US 9,417,592 B2
(45) Date of Patent: Aug. 16, 2016

(54) IMAGE FORMING APPARATUS

(71) Applicants: Hidenobu Kondo, Nagoya (JP); Isao Kubo, Tokoname (JP); Hideki Arimoto, Nagoya (JP); Kyoichi Morita, Anjo (JP); Takahiro Ikeno, Seto (JP)

(72) Inventors: Hidenobu Kondo, Nagoya (JP); Isao Kubo, Tokoname (JP); Hideki Arimoto, Nagoya (JP); Kyoichi Morita, Anjo (JP); Takahiro Ikeno, Seto (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 672 days.

(21) Appl. No.: 13/851,424

(22) Filed: Mar. 27, 2013

(65) Prior Publication Data

US 2013/0257929 A1 Oct. 3, 2013

(30) Foreign Application Priority Data

Mar. 30, 2012 (JP) ..... 2012-079720

(51) Int. Cl.
*G03G 15/00* (2006.01)

(52) U.S. Cl.
CPC ..... *G03G 15/80* (2013.01)

(58) Field of Classification Search
CPC ..... G03G 15/80; G05F 1/563
See application file for complete search history.

(56) References Cited

U.S. PATENT DOCUMENTS 3,961,165 A * 6/1976 Fukuoka ..... H04N 1/053 358/471
5,270,913 A * 12/1993 Limpaecher ..... H02J 3/18 307/109

(Continued)

FOREIGN PATENT DOCUMENTS

JP 2006-277760 A 10/2006
JP 2006-311748 A 11/2006

(Continued)

OTHER PUBLICATIONS

Official Action dated Feb. 2, 2016 received from the Japanese Patent Office in related JP-2012-079720.

*Primary Examiner* — Thienvu Tran
*Assistant Examiner* — Pinping Sun
(74) *Attorney, Agent, or Firm* — Scully, Scott, Murphy & Presser, PC

(57) ABSTRACT

An image forming apparatus may includes a central processing device, a first switching regulator and a second switching regulator. The central processing device may perform information processing associated with image formation. The first switching regulator may receive an input of a first voltage and output a second voltage which is lower than the first voltage. The second switching regulator may receive an input of the second voltage and output a third voltage which is lower than the second voltage. The third voltage may be input to the central processing device. A first switching frequency which is a switching frequency of the first switching regulator may be lower than a second switching frequency which is a switching frequency of the second switching regulator.

10 Claims, 5 Drawing Sheets

(56) References Cited

U.S. PATENT DOCUMENTS 6,674,268 B2 * 1/2004 Rutter ..... H02M 1/08 323/224
7,071,660 B2 * 7/2006 Xu ..... H02M 3/156 323/266
7,394,231 B2 * 7/2008 Flatness ..... H02M 3/1582 323/225
8,217,633 B2 * 7/2012 Shimizu ..... H02M 1/36 323/224
8,228,047 B2 * 7/2012 Li ..... H02J 1/08 307/66
8,339,184 B2 * 12/2012 Kok ..... H03K 17/687 327/536
8,564,260 B2 * 10/2013 Carobolante ..... H02M 3/1588 323/266
2005/0007086 A1 * 1/2005 Morimoto ..... H02M 3/1584 323/282
2009/0039843 A1 2/2009 Kudo
2010/0127683 A1 * 5/2010 Uno ..... H01L 23/49524 323/282
2010/0176782 A1 7/2010 Kudo
2010/0239303 A1 9/2010 Matsumoto
2011/0018620 A1 * 1/2011 Moriguchi ..... G11C 11/40615 327/537
2011/0101940 A1 5/2011 Kudo
2011/0204858 A1 8/2011 Kudo
2012/0217942 A1 8/2012 Kudo
2014/0035551 A1 2/2014 Kudo

FOREIGN PATENT DOCUMENTS

JP 2008-017620 A 1/2008
JP 2009-022092 A 1/2009
JP 2009-044831 A 2/2009
JP 2010-226845 A 10/2010
JP 2011-097755 A 5/2011
JP 2011-172346 A 9/2011

* cited by examiner

IMAGE FORMING APPARATUS

CROSS-REFERENCE TO RELATED APPLICATIONS

This application claims priority to Japanese Patent Application No. 2012-079720, filed on Mar. 30, 2012, the contents of which are hereby incorporated by reference into the present application.

TECHNICAL FIELD

This specification relates to an image forming apparatus that comprises a switching regulator or the like.

DESCRIPTION OF RELATED ART

A multi-output power supply circuit that generates and outputs at plurality of voltages is known in general.

SUMMARY

For example, a multi-output power supply circuit mounted on a printer needs to supply a relatively high voltage to a driving unit such as a motor controller. Moreover, the multi-output power supply circuit needs to supply a voltage that is lower than the voltage supplied to the driving unit and has small ripple to a controller such as a CPU or an ASIC. Here, when a low voltage with small ripple is generated from a supply voltage supplied to a printer using a switching regulator that is provided in the multi-output power supply circuit, it is necessary to increase switching frequency. However, if the switching frequency is increased when the supply voltage is high, large radiation noise may occur. In this case, since it is difficult to generate voltages appropriate for various circuits such as a driving unit or a controller as well as reducing radiation noise, it is inconvenient for users.

One technique disclosed in the present application is an image forming apparatus. The image forming apparatus may includes a central processing device, a first switching regulator and a second switching regulator. The central processing device may perfbun information processing associated with image formation. The first switching regulator may receive an input of a first voltage and output a second voltage which is lower than the first voltage. The second switching regulator may receive an input of the second voltage and output a third voltage which is lower than the second voltage. The third voltage may be input to the central processing device. A first switching frequency which is a switching frequency of the first switching regulator may be lower than a second switching frequency which is a switching frequency of the second switching regulator.

EMBODIMENT

<Configuration of Image Forming Apparatus>

Figure 1:
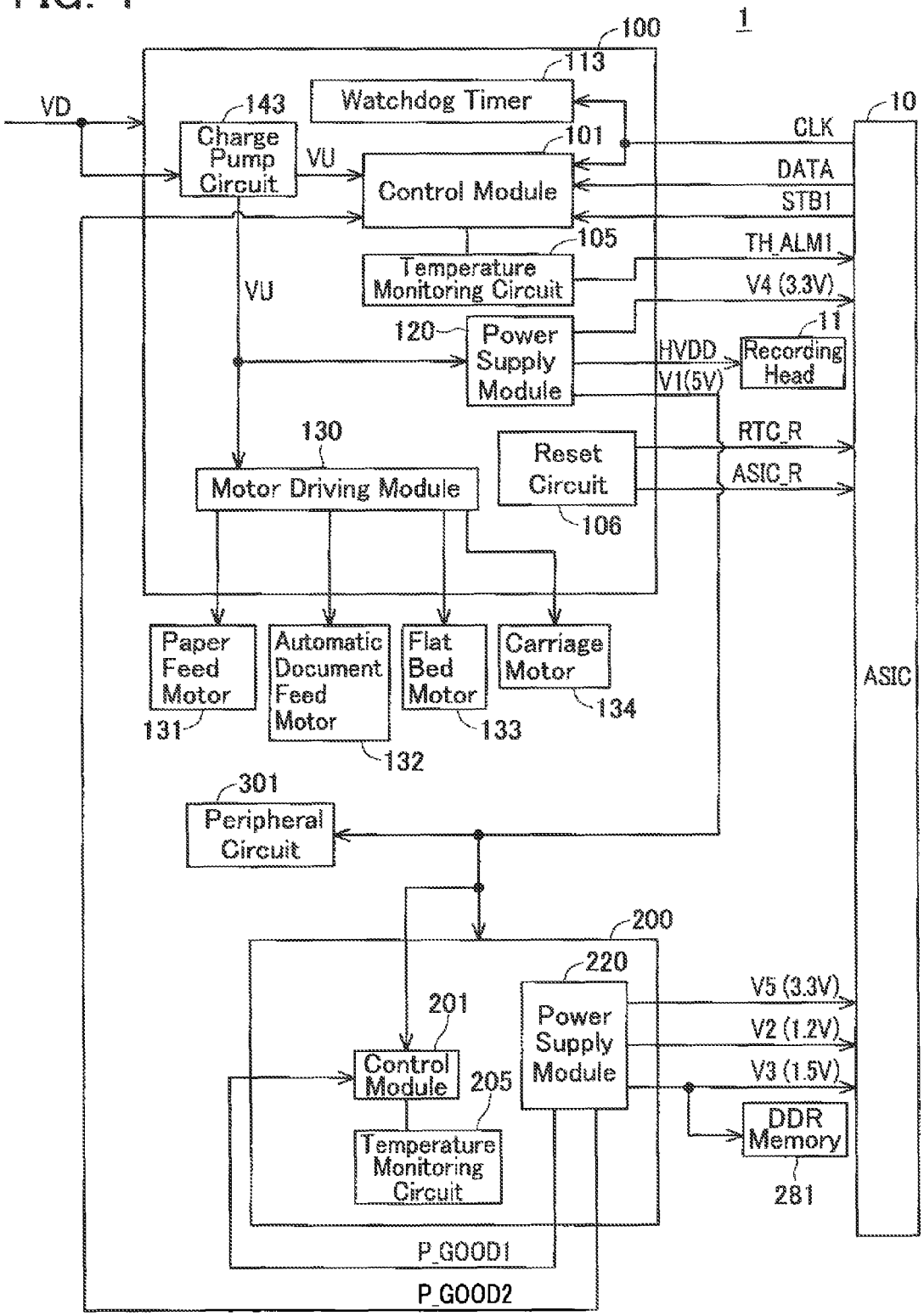
FIG. 1 shows a block diagram showing a control configuration of an image forming apparatus.

FIG. 1 is a block diagram showing a control configuration of an image forming apparatus according to this specification. The image forming apparatus 1 is an image forming apparatus that uses an ink jet recording head. As shown in FIG. 1, the image fin-ming apparatus 1 includes an application specific integrated circuit (ASIC) 10, a recording head 11, power management devices 100 and 200, a paper feed motor 131, an automatic document feed motor 132, a flat bed motor 133, a carriage motor 134, a DDR memory 281, and a peripheral circuit 301. The ASIC is an application specific integrated circuit that generates a control signal for controlling vanous motors such as the carriage motor 134 and the recording head 11. The ASIC 10 may be a CPU and an ASIC, or a system IC and an LSI which are onechip ICs in which the CPU and the ASIC are integrated.

The power management devices 100 and 200 are formed as separate integrated circuits (ICs). The power management devices 100 and 200 are complex ICs that include a switching control circuit for power supply. That is, the image formitng apparatus 1 according to this specification has a configuration in which two complex ICs are used.

The paper feed motor 131 is a motor for feeding whiting paper to a recording position. The automatic document feed motor 132 is a motor for continuously feeding a plurality of sheets of printing paper. The flat bed motor 133 is a motor for moving a reading unit. The carriage motor 134 is a motor for moving a carriage that perfbims printing in a scanning direction in a reciprocating manner. The paper feed motor 131 and the carriage motor 134 are DC motors. Moreover, the automatic document feed motor 132 and the flat bed motor 133 are step motors.

The recording head 11 is a component that discharges ink according to as ink jet method to perform recording. The recording head 11 is mounted on the carriage. The DDR memory 281 is a synchronous dynamic random access memory (DRAM). The peripheral circuit 301 includes various circuits (for example, a USB host).

<Power Management Device 100>

Figure 2:
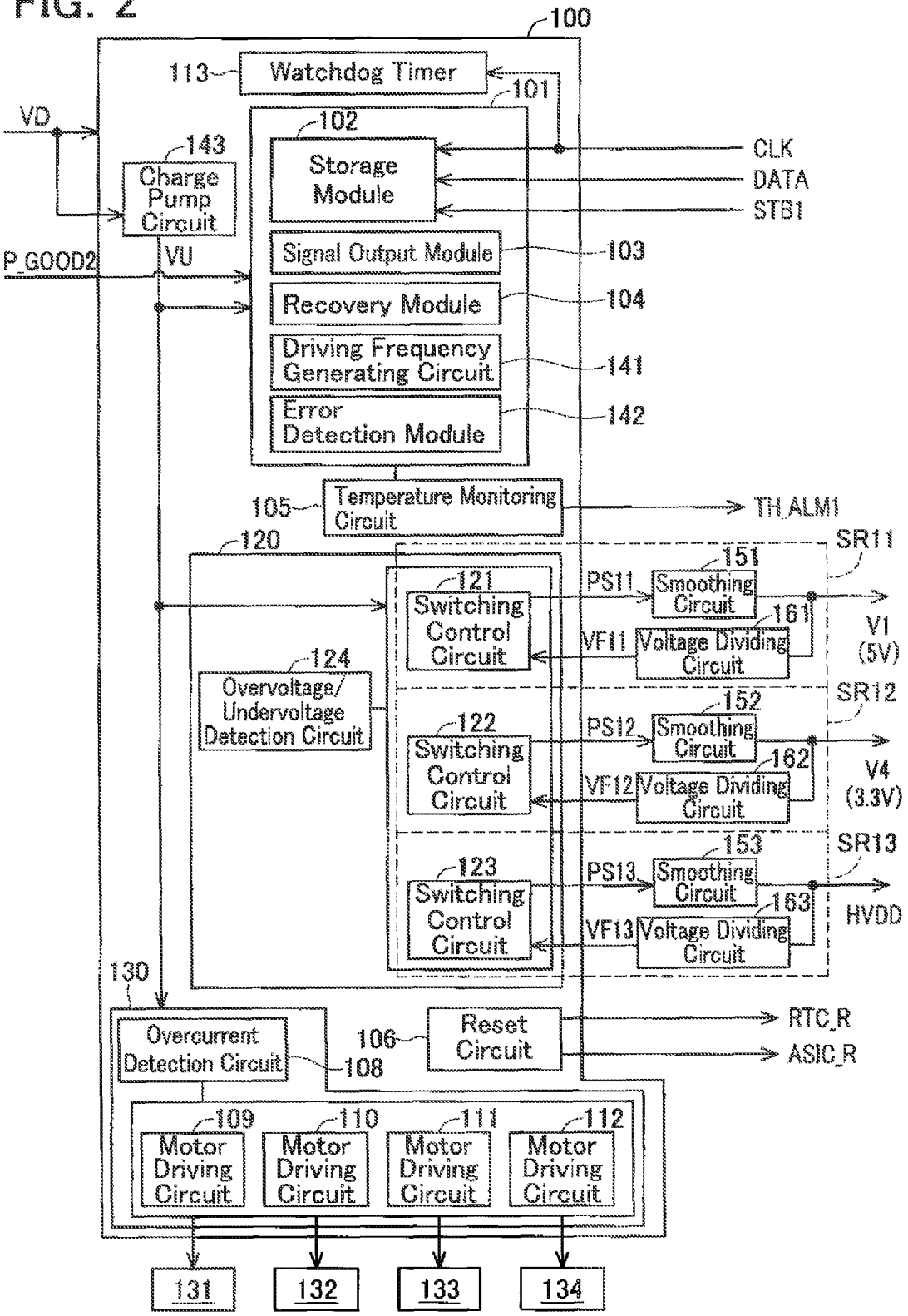
FIG. 2 shows a first detailed block diagram of a power management device.

FIG. 2 shows a detailed block diagram of the power management device 100. The power management device 100 includes a control module 101, a power supply module 120, a motor driving module 130, a temperature monitoring circuit 105, a reset circuit 106, a watchdog timer 113, and a charge pump circuit 143.

An input voltage VD (31 volts) is input to the charge pump circuit 143. A step-up voltage VU obtained by stepping up the input voltage VD is output from the charge pump circuit 143. The step-up voltage VU is input to the control module 101, switching control circuits 121 to 123, and the motor driving module 130.

The configuration of the power supply module 120 will be described. The power supply module 120 includes the switching control circuits 121 to 123 and an overvoltagetundervoltage detection circuit 124. The switching control circuit 121, a smoothing circuit 151, and a voltage dividing circuit 161 form a switching regulator SR11. The switching control circuit 122, a smoothing circuit 152, and a voltage dividing circuit 162 form a switching regulator SR12. The switching control circuit 123, a smoothing circuit 153, and a voltage dividing circuit 163 form a switching regtilator SR13. The input voltage VD and the step-up voltage VU are input to the switching regulators SR11 to SR13. A 5-volt voltage V1 output from the switching regulator SR11 is input to the power management device 200 and the peripheral circuit 301. A 3.3-volt voltage V4 output from the switching regulator SR12 is input to the ASIC 10. A voltage HVDD output from the switching regulator SR13 is input to the recording head 11. The overvoltage/undervoltage detection circuit 124 is a circuit that detects whether the output voltage of each of the switching regulators SR11 to SR13 has increased or decreased beyond a predetermined percentage from a setting voltage.

Figure 4:
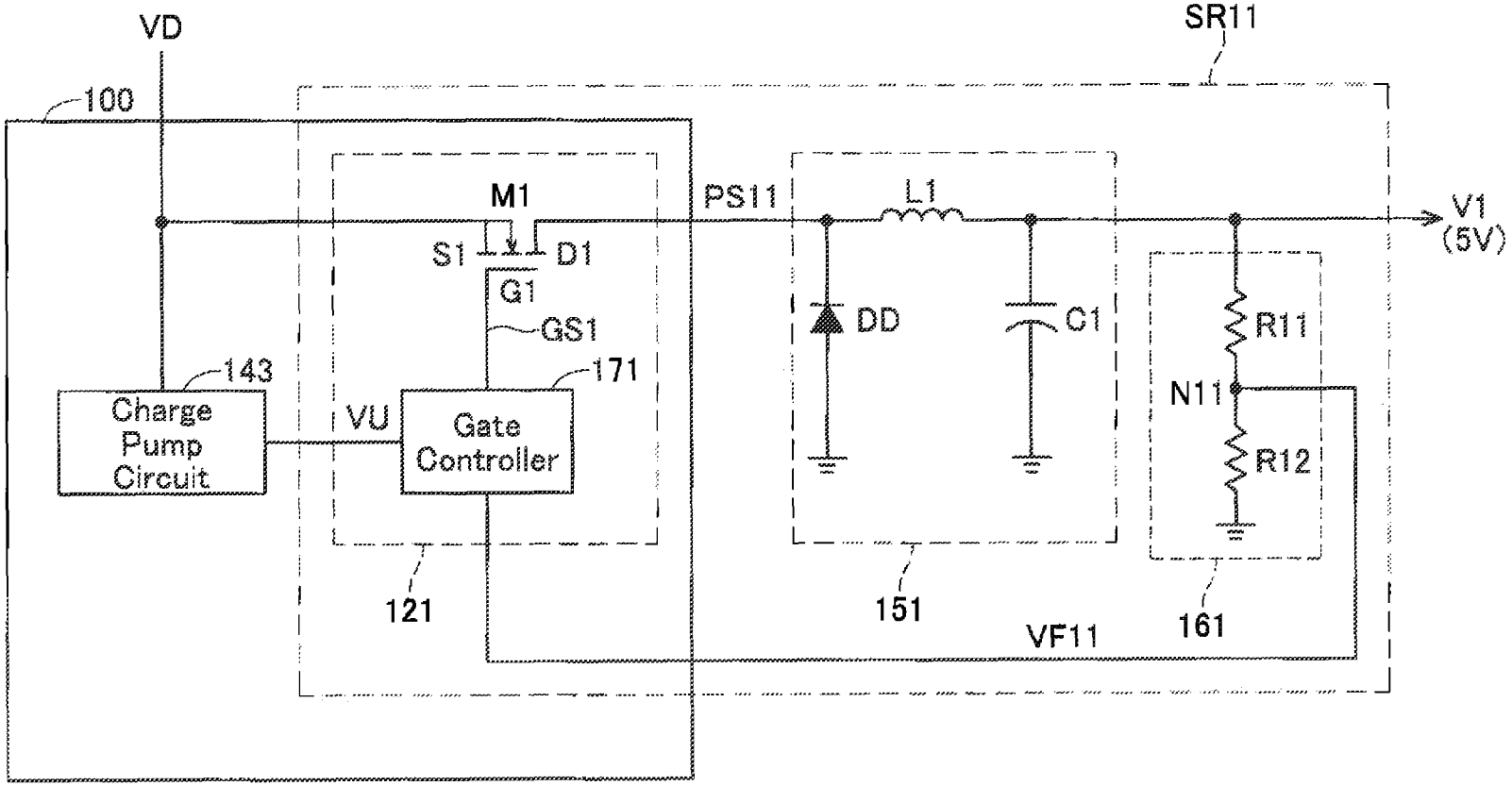
FIG. 4 shows a first detailed block diagram of a switching regulator.

The detailed configuration of the switching regulator SR11 will be described with reference to FIG. 4. The switching control circuit 121 includes a gate controller 171 and an NMOS transistor M1. The gate controller 171 receives the step-up voltage VU output from the charge pump circuit 143 and a feedback voltage VF11 output from the voltage dividing circuit 161 and outputs a gate control signal GS1. The gate control signal GS1 is a voltage that is generated based on the step-up voltage VU and is higher than the input voltage VD (31 volts). The input voltage VD is input to a source terminal S1 of the NMOS transistor M1. A gate terminal G1 is connected to the gate controller 171, and receives the gate control signal GS1. A drain terminal D1 is connected to the smoothing circuit 151 and a pulse voltage PS11 is output from the drain terminal D1. Ideally, the amplitude of the pulse voltage PS11 corresponds to the input voltage VD (31 volts). In actuality, the amplitude of the pulse voltage PS11 is somewhat smaller than the input voltage VD. This is because a voltage drop occurs by the various types of elements (e.g. transistors) provided for the switching control circuit 121. In this specification, the voltage drop occurred at the switching control circuit 121 will be ignored.

The smoothing circuit 151 includes a diode DD, a coil L1, and a capacitor C1. The diode DD is a schottky barrier diode (SBD). An anode terminal of the diode DD is connected to the ground. A cathode terminal of the diode DD is connected to the Drain terminal D1 of the NMOS transistor M1 and one end of the coil L1. The other end of the coil L1 is connected to one end of the capacitor C1 and an input terminal of the voltage dividing circuit 161. The other end of the capacitor C1 is connected to the ground.

The voltage dividing circuit 161 includes resistors R11 and R12. One end of the resistor R11 is connected to the capacitor C1. The other end of the resistor R11 is connected to one end of the resistor R12 at a node N11. The other end of the resistor R12 is connected to the ground. The node N11 is connected to the gate controller 171. The feedback voltage VF11, which is a voltage obtained by dividing the voltage V1 output from the smoothing circuit 151, is output from the node N11.

The operation of the switching regulator SR11 will be described. The switching regulator SR11 switches the NMOS transistor M1 at a switching frequency f1 according to the gate control signal GS1. The switching frequency f1 may be 350 KHz, the example. The duty ratio of the pulse voltage PS11 is controlled by the switching control, so that the input voltage VD (31 volts) is controlled to be stepped down to a stable voltage V1 (5 volts). The control of regulating the input voltage VD to the voltage V1 is peribrmed based on the feedback voltage VF11. Since the detailed configuration of the switching regulators SR12 and SR13 is the same as the detailed configuration of the switching regulator SR11, the description thereof will not be provided.

The configuration of the control module 101 will be described. The control module 101 includes a storage module 102, a signal output module 103, a recovery module 104, a driving frequency generating circuit 141, and an error detection module 142. The control module 101 receives a signal P_GOOD2 from the power management device 200. The control module 101 also receives the input voltage VD and the step-up voltage V1. The control module 101 is configured to communicate with circuits included in the power management device 100, such as the power supply module 120, an overcurrent detection circuit 108, a reset circuit 106, and the watchdog timer 113, which are not shown in FIG. 2. The control module 101 is controlled by the ASIC 10 according to serial communication. Specifically, serial communication is performed according to three control signals of a clock signal CLK, a data signal DATA, and a strobe signal STB1. As a result, 16-bit serial data can be communicated.

The storage module 102 receives the clock signal CLK, the data signal DATA, and the strobe signal STB1 from the ASIC 10. The storage module 102 is a register that stores setting information sent from the ASIC 10 according to the serial communication. Examples of the setting information stored in the storage module 102 includes a recovery signal for recovering the operation of the motor driving module 130 and a print instruction for performing printing on printing paper using the recording head 11.

The signal output module 103 outputs an alarm signal TH_ALM1 to the ASIC 10 when the temperature monitoring circuit 105 detects an error. The recovery module 104 recovers the operation of the motor driving module 130 being stopped when the recovery signal is input from the ASIC 10. The recovery signal is input from the ASIC 10 according to the serial communication. The driving frequency generating circuit 141 is a circuit that generates the switching frequency f1 of each of the switching regulators SR11 to SR13. The error detection module 142 is a circuit that detects various errors that occur in the internal circuits of the power management device 100.

The watchdog timer 113 receives the clock signal CLK from the ASIC 10. The clock signal CLK may be used as a motor reference clock signal. The watchdog timer 113 is a circuit that stops motor driving circuits 109 to 112 using a protection circuit 107 (not shown when an error is detected in the motor reference clock signal.

The temperature monitoring circuit 105 is a circuit that detects the inner temperature of the power management device 100. The reset circuit 106 is a circuit that outputs a reset signal RTC_R or a reset signal ASIC_R to the power management device 200 when the temperature monitoring circuit 105 or the error detection module 142 detects an error. The reset signal RTC_R is a signal for resetting a real time clock (RTC) (not shown) included in the ASIC 10. The reset signal ASIC_R is a signal for resetting the ASIC 10.

The configuration of the motor driving module 130 will be described. The motor driving module 130 includes the motor driving circuits 109 to 112 and the overcurrent detection circuit 108. The motor driving circuits 109 to 112 are circuits that each drive corresponding one of the paper feed motor 131 to the carriage motor 134. The motor driving circuits 110 and 111 each include two H-bridge circuits (not shown). As a result, it is possible to drive the automatic document feed motor 132 and the flat bed motor 133 which use a step motor. Thus, it is possible to control paper feeding with higher accuracy. Moreover, the motor driving circuit 109 and 112 each includeone H-bridge circuit (not shown). The H-bridge circuits of the motor driving circuits 109 to 112 include an NMOS transistor. The gate control signal of the NMOS transistor is generated based on the step-up voltage VU and has a voltage higher than the input voltage VD. The motor driving circuits 109 and 112 supply large electric power to the paper feed motor 131 to the carriage motor 134. Thus, by using an H-bridge circuit which includes an NMOS transistor of which the ON-resistance is smaller than that of a PMOS transistor, it is possible to suppress the amount of generated heat and the amount of energy loss in the motor driving circuits 109 to 112.

The overcurrent detection circuit 108 detects whether an electric current beyond a predetermined value flows in the paper feed motor 131 to the carriage motor 134. In this manner, it is possible to detect the occurrence of an error (specifically, a short circuit). Further, it is possible to detect an overload state (such as paper jam) where a motor load is very large.

<Power Management Device 200>

Figure 3:
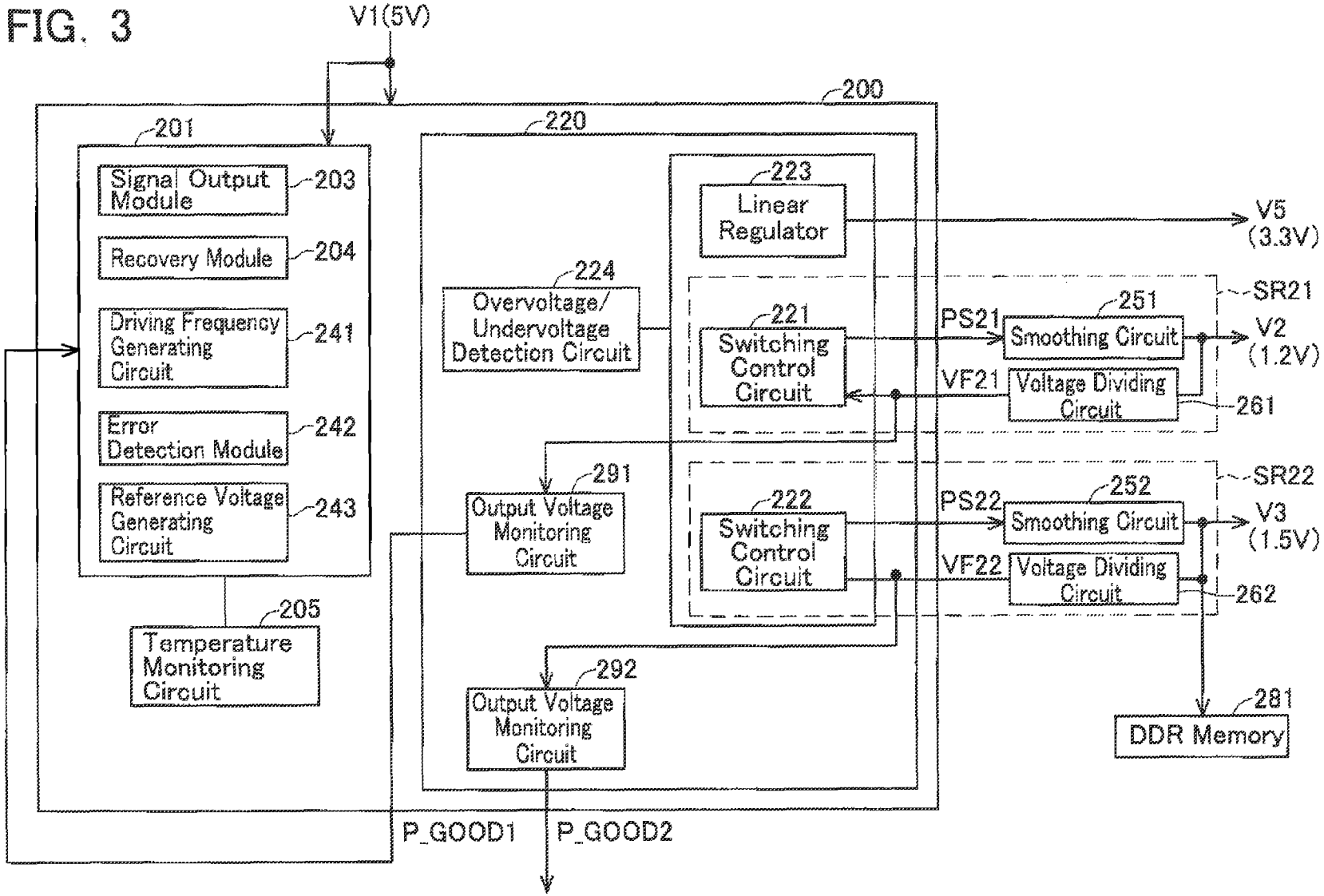
FIG. 3 shows a second detailed block diagram of a power management device.

FIG. 3 shows a detailed block diagram of the power management device 200. The power management device 200 includes a control module 201, a power supply module 220, and a temperature monitoring circuit 205.

The configuration of the power supply module 220 will be described. The power supply module 220 includes switching control circuits 221 and 222, a linear regulator 223, an overvoltagelundervoltage detection circuit 224, and output voltage monitoring circuits 291 and 292. The switching control circuit 221, a smoothing circuit 251, and a voltage dividing circuit 261 form a switching regulator SR21. The switching control circuit 222, a smoothing circuit 252, and a voltage dividing circuit 262 form a switching regulator SR22. A 5-volt voltage V1 is input to the switching regulators SR21 and SR22 and the linear regulator 223. A 1.2-volt voltage V2 output from the switching regulator SR21 is input to the ASIC 10. The voltage V2 is a core voltage that is supplied to a core portion that executes various arithmetic operations. A 1.5-volt voltage V3 output from the switching regulator SR22 is input to the ASIC 10 and the DDR memory 281.

A 3.3-volt voltage V5 output from the linear regulator 223 is input to the ASIC 10. The linear regulator 223 is a low-dropout voltage regulator (LDO) which operates with a very small input-output differential voltage. The voltage V5 is used for AD conversion. A reference voltage for regulating the voltage V5 to a setting voltage (3.3 volts) is supplied from a reference voltage generating circuit 243.

The output voltage monitoring circuit 291 receives a feedback voltage VF21 output from the voltage dividing circuit 261. The output voltage monitoring circuit 291 outputs a sigial P_GOOD1 which is input to the control module 201. The output voltage monitoring circuit 291 is a circuit that monitors whether the voltage V2 output from the switching regulator SR21 is regulated to the setting voltage (1.2 volts) and informs the control module 201 of the monitoring results using the signal P_GOOD1.

The output voltage monitoring circuit 292 receives a feedback voltage VF22 output from the voltage dividing circuit 262. The output voltage monitoring circuit 292 outputs a signal P_GOOD2 which is input to the control module 101 of the power management device 100. The output voltage monitoring circuit 292 is a circuit that monitors whether the voltage V3 output from the switching regulator SR22 is regulated to the setting voltage (1.5 volts) and informs the control module 101 of the monitoring results using the signal P_GOOD2. The overvoltagehmdervoltage detection circuit 224 is a circuit that detects whether the output voltages of the switching control circuits 221 and 222 and the output voltage of the linear regulator 223 have increased or decreased beyond a predetermined percentage from the setting voltage.

Figure 5:
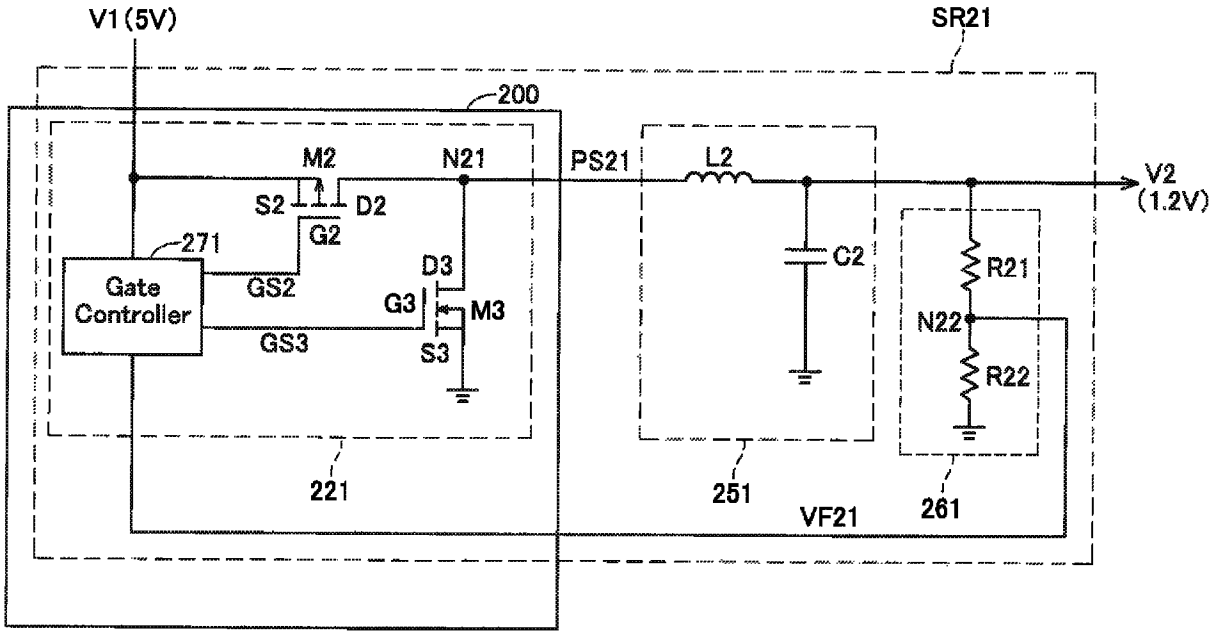
FIG. 5 shows a second detailed block diagram of a switching regulator.

The detailed configuration of the switching regulator SR21 will be described with reference to FIG. 5. The switching control circuit 221 includes a gate controller 271, a PMOS transistor M2, and an NMOS transistor M3. The gate controller 271 receives the voltage V1 (5 volts) output from the power management device 100 and the feedback voltage VF21 output from the voltage dividing circuit 261 and outputs gate control signals GS2 and GS3. The gate control signals GS2 and GS3 are voltages that are generated based on the voltage V1 and are lower than the voltage V1. The voltage V1 is input to a source terminal S2 of the PMOS transistor 142. A gate terminal D2 is connected to the gate controller 271, and receives the gate control signal GS2. A drain terminal D2 of the PMOS transistor M2 is connected to a drain terminal D3 of the NMOS transistor M3 and the smoothing circuit 251, at a node N21. A source terminal S3 of the NMOS transistor M3 is connected to the ground. A gate terminal G3 is connected to the gate controller 271, and receives the gate control signal GS3. A pulse voltage PS21 is output from the node N21. Ideally, the amplitude of the pulse voltage PS21 corresponds to the voltage V1 (5 volts). In actuality, the amplitude of the pulse voltage PS21 is somewhat smaller than the voltage V1. This is because a voltage drop occurs by the various types of elments (e.g. transistors) provided for the switching control circuit 221. In this specification, the voltage drop occurred at the switching control circuit 221 will be ignored.

The smoothing circuit 251 includes a coil L2 and a capacitor C2. One end of the coil L2 is connected to the node N21. The other end of the coil L2 is connected to one end of the capacitor C2 and an input terminal of the voltage dividing circuit 261. The other end of the capacitor C2 is connected to the ground.

The voltage dividing circuit 261 includes resistors R21 and R22. One end of the resistor R21 is connected to the capacitor C2. The other end of the resistor R21 is connected to one end of the resistor R22 at a node N22. The other end of the resistor R22 is connected to the ground. The node N22 is connected to the gate controller 271. The feedback voltage VF21 which is a voltage obtained by dividing the voltage V2 output from the smoothing circuit 251 is output from the node N22.

The operation of the switching regulator SR21 will be described. The switching regulator SR21 switches the PMOS transistor M2 at a switching frequenLy f2 according to the gate control signal GS2. The switching frequency f2 is higher than the switching frequency f1. The switching frequency f2 may be 2 MHz, for example. Moreover, synchronous rectification control is realized by causing the NMOS transistor M3 to perform a complementary operation relative to the PMOS transistor M2 according to the gate control signal GS3. The duty ratio of the pulse voltage PS21 is controlled by the switching control, and the input voltage V1 (5 volts) is controlled so as to be stepped down to a stable voltage V2 (1.2 volts). The control of regulating the voltage V1 to the voltage V2 is performed based on the feedback voltage VF21. Since the use of the NMOS transistor M3 that performs synchronous rectification eliminates the use of the diode DD as included in the switching regulator SR11 (see FIG. 4), it is possible to reduce the mounting area of the switching regulator SR21. Since the detailed configuration of the switching regulator SR22 is the same as the detailed configuration of the switching regulator SR21, the description thereof will not be provided.

The configuration of the control module 201 will be described. The control module 201 includes a signal output module 203, a recovery module 204, a driving frequency generating circuit 241, an error detection module 242, and the reference voltage generating circuit 243. The control module 201 receives the voltage V1. The control module 201 also receives the signal P_GOOD1 from the output voltage monitoring circuit 291. The reference voltage generating circuit 243 is a circuit that generates a reference voltage used by the linear regulator 223. The other constituent components of the power management device 200 (FIG. 3) have the same functions as the constituent components having the same names, of the power management device 100 (FIG. 2). Thus, the detailed description thereof will not be provided.

<Relationship Between Power Management Devices 100 and 200>

The relationship between the power management devices 100 and 200 will be described. The switching frequency 12 (2 MHz) of the switching regulators SR21 and SR22 of the power management device 200 is higher than the switching frequency f1 (350 KHz) of the switching regulator SR11 of the power management device 100. Thus, the inductance value of the coil provided in the smoothing circuits 251 and 252 can be made smaller than the inductance value of the coil provided in the smoothing circuits 151 to 153. Moreover, the capacitance value of the capacitor provided in the smoothing circuits 251 and 252 can be made smaller than the capacitance value of the capacitor provided in the smoothing circuits 151 to 153. That is, the size of the smoothing circuit 251 and 252 can be made smaller than the size of the smoothing circuits 151 to 153. As a result, since the space required for disposing the smoothing circuits 251 and 252 around the power management device 200 can be made smaller than the space required for disposing the smoothing circuits 151 to 153 around the power management device 100, the power management device 200 can be disposed at a position closer to the ASIC 100 as compared to the power management device 100. Thus, since the wire length between the ASIC 10 and the power management device 200 that operates at the switching frequency f2 (2 MHz) can be made shorter than the wire length between the ASIC 10 and the power management device 100 that operates at the switching frequency f1 (350 KHz), it is possible to reduce the radiation noise of the high frequency, radiated through the wires.

<Operation of Image Funning Apparatus 1>

The operation of the image forming apparatus 1 will be described. In the image forming apparatus 1, the carriage motor 134 moves a carriage (not shown) having thereon the recording head 11 that discharges ink to perfinni recording in a reciprocating manner. Specifically, when the carriage motor 134 rotates in the forward and backward directions, the carriage moves along a guide shaft (not shown) in a reciprocating manner. Moreover, when the paper feed motor 131 is driven, printing paper is fed by a paper feeding mechanism (not shown) and is transported to a recording position, and at the recording position, ink is discharged to the surface of the printing paper from the recording head 11, whereby recording is performed.

<Advantages 22

The advantages of the image forming apparatus 1 disclosed in this specification will be described. The radiation noise of the switching regulator increases with higher input voltage, switching frequency, output current value, and the like. In the image forming apparatus 1 disclosed in this specification, the input voltage VD (31 volts) that is higher than the voltage V1 (5 volts) is input to the switching regulators SR11 to SR13 of the power management device 100. Moreover, the switching frequency f1 (350 KHz) of the switching regulators SR11 to SR13 is set to be lower than the switching frequency f2 (2 MHz) of the switching regulators SR21 and SR22. Due to this, even when the input voltage VD (31 volts) which is a relatively high voltage is input to the switching regulators SR11 to SR13, it is possible to suppress the occurrence of radiation noise. Further, the voltage supplied to the controller such as the ASIC 10 needs to be a highly accurate voltage which is less ripple than the voltage supplied to the driving unit such as a motor. Although it is necessary to increase the switching frequency in order to generate a voltage with small ripple, large radiation noise may occur if the switching frequency is increased. In the image forming apparatus 1 disclosed in this specification, the voltage V1 (5 volts) generated by stepping down the input voltage VD (31 volts) is input to the switching regulators SR21 and SR22 (of the power management device 200) that supply a voltage to the ASIC 10. Due to this, even when switching control is performed using the switching frequency f2 (2 MHz) which is a relatively high frequency, it is possible to suppress the occurrence of radiation noise. From the above, it is possible to generate voltages appropriate for various circuits as well as reducing the radiation noise.

The range of the switching frequencies f1 of the switching regulators SR11 to SR13 and the range of the switching frequencies f2 of the switching regulators SR21 and SR22 can be determined according to various factors. The lower limit of the switching frequency can be detehnined based on the magnitude of allowable ripple in a supply destination of the voltage that is output from the switching regulator, for example. This is because the ripple of the output voltage increases as the switching frequency decreases. The lower limit of the switching frequency f2 can be determined based on an allowable ripple voltage in the DDR memory 281 which is a destination of the voltage V3 output from the switching regulator SR22, and for example, may be 1 MHz. The lower limit of the switching frequency f1 may be 100 KHz, for example. The upper limit of the switching frequency can be determined based on the amount of loss and the amount of generated heat allowed for the switching regulator, for example. This is because, when the pulse voltage has large amplitude, the amount of loss and the amount of generated heat are likely to increase as the switching frequency increases. The upper limit of the switching frequency 11 is low because the difference between the input voltage and the output voltage of the switching regulators SR11 to SR13 (with the switching frequency 11) is larger than that of the switching regulators SR21 and SR22 (with the switching frequency 12). The upper limit of the switching frequency f1 may be 500 KHz, for example.

In the image forming apparatus 1 disclosed in this specification, the switching control circuits 121 to 123 that receive the input voltage VD and operate at the switching frequency f1 are mounted on the power management device 100. Moreover, the switching control circuits 221 and 222 that receive the voltage V1 and operate at the switching frequency 12 are mounted on the power management device 200. That is, the switching control circuits 121 to 123 and the switching control circuit 221 and 222 are mounted on separate ICs. Due to this, it is possible to better suppress the influence (for example, interference due to noise) of both switching control circuits as compared to a case Where the switching control circuits 121 to 123 and the switching control circuits 221 and 222 are integrally mounted on one IC.

The ON-resistance of the NMOS transistor is lower than that of the PMOS transistor. However, in order to control the NMOS transistor, a voltage that is higher than the source voltage by a gate threshold voltage needs to be applied to the gate. In the image funning apparatus 1 disclosed in this specification, the power management device 100 includes the charge pump circuit 143 that generates the step-up voltage VU that is higher than the input voltage VD. Moreover, the gate controller of each of the switching control circuits 121 to 123 (FIG. 4) generates a gate control signal that is higher than the input voltage VD based on the step-up voltage VU. Due to this, in the switching control circuits 121 to 123, an NMOS transistor can be used as a power switching element in which the input voltage VD is input to the source terminal. Therefore, it is possible to reduce the amount of generated heat and the amount of energy loss in the switching control circuits as compared to the case of using a PMOS transistor.

The power management device 100 includes the charge pump circuit 143. This is because it is necessary to supply the step-up voltage VU to the motor driving module 130 in order to drive the NMOS transistor included in the H-bridge circuit of the motor driving module 130. Moreover, the step-up voltage VU is also supplied to the switching control circuits 121 to 123. That is, the charge pump circuit 143 can be shared by the motor driving module 130 and the switching control circuits 121 to 123. As a result, it is possible to eliminate the need to mount the charge pump circuit on the power management device 100 for the sole purpose of operating the switching control circuits 121 to 123 and to reduce the cost.

In order to control a PMOS transistor, a voltage that is lower than the source voltage by a gate threshold voltage needs to be applied to the gate. In the image forming apparatus 1 disclosed in this specification, the power management device 200 uses the PMOS transistor as a power switching element of the switching control circuits 221 and 222 (FIG. 5). Moreover, the gate controller of each of the switching control circuits 221 and 222 generates a gate control signal that is lower than the voltage V1 based on the voltage V1 (5 volts). As a result, since it is possible to eliminate the need to provide a step-up circuit that steps up the input voltage V1 to the power management device 200, it is possible to reduce the size of the power management device 200 and the mounting area.

While specific embodiments of the present invention have been described in detail above, such description is for illustrative purposes only and is not intended to limit the scope and claims of the invention. Techniques described in the claims of the invention include various modifications and changes made to the specific examples illustrated above.

<Modifications>

Although a case where the power management devices 100 and 200 are formed as separate ICs has been described, the present invention is not limited to such an embodiment. For example, the power management devices 100 and 200 may be integrated into one IC. Moreover, the functions of the power management devices 100 and 200 may be realized by three or more separate ICs. The more ICs are used, the better it is possible to improve heat radiationproperties, the degree of freedom in layout, and the noise reduction effect.

The smoothing circuits 151 to 153 and the smoothing circuits 251 and 252 may be included in the power management devices 100 and 200 without being limited to being provided as the external components of the power management devices 100 and 200. The voltage dividing circuits 161 to 163 and the voltage dividing circuits 261 and 262 may be included in the power management devices 100 and 200 without being limited to being provided as the external components of the power management devices 100 and 200.

The values of the switching frequencies f1 and f2, the input voltage VD, and the voltages V1 to V5 are examples only, and the technique disclosed in this specification can also be applied to when other values are used.

In this embodiment, five Ft itching regulators are included in total. However, the number is not limited to five, and the tecimique disclosed in this specification can also be applied to when four or smaller or six or more switching regulators are included.

In this embodiment, although a case where the technique-disclosed in this specification is applied to an ink jet image forming apparatus has been described as an example, the technique disclosed in this specification is not limited to this. The technique disclosed in this specification can be applied to control circuits of various apparatuses without being limited to an image forming apparatus, if the circuit includes a motor driving circuit and a plurality of switching regulators.

Although a case where the power management device 100 is controlled by the ASIC 10 according to serial communication has been described, communication may be performed via a plurality of signal lines (parallel transmission) if there is no restriction on the number of signal lines, a layout, and the like.

Moreover, in the embodiment, although a case where a plurality of switching regulators is included in the power management devices 100 and 200 has been described, the technique disclosed in this specification can also be applied to a case where a plurality of power supply circuits other than the switching regulators is included.

An ASIC 10 and a CPU are examples of "a central processing device". An input voltage VD is an example of "a first voltage". A voltage V1 is an example of "a second voltage". A switching regulator SR11 is an example of "a first switching regulator". A voltage V2 and V3 are examples of "a third voltage". A switching frequency f1 is an example of "a first switching frequency". A switching frequency f2 is an example of "a second switching frequency". A switching control circuit 121 is an example of "a first switching unit". A smoothing circuit 151 is an example of "a first smoothing unit". A pulse voltage PS11 is an example of "a first pulse voltage". Switching control circuits 221 and 222 are examples of "a second switching unit". Smoothing circuits 251 and 252 are examples of "a second smoothing unit". A pulse voltage PS21 is an example of "a second pulse voltage". A power management device 100 is an example of "a first power management device". A power management device 200 is an example of "a second power management device". A step-up voltage VU is an example of "a fourth voltage". A charge pump circuit 143 is an example of "a step-up circuit". A gate control signal GS1 is an example of "a voltage based on the fourth voltage". A voltage V5 is an example of "a fifth voltage". A linear regulator 223 is an example of "a series regulator". A coil L1 is an example of "a first coil". A capacitor C1 is an example of "a first capacitor". A coil L2 is an example of "a second coil". A capacitor C2 is an example of "a second capacitor". A DDR memory 281 is an example of "a synchronous DRAM".

What is claimed is:

1. An image forming apparatus comprising:

a central processing device configured to perform information processing associated with image formation;

a first switching regulator configured to receive an input of a first voltage and configured to output a second voltage which is lower than the first voltage, the first switching regulator comprising a first switching unit configured to control the output of the first switching regulator;

a second switching regulator configured to receive an input of the second voltage and configured to output a third voltage which is lower than the second voltage;

a step-up circuit that steps up the first voltage so as to generate a fourth voltage which is higher than the first voltage; and a motor driving module configured to drive a motor used for the image formation, wherein the third voltage is input to the central processing device, a first switching frequency which is a switching frequency of the first switching regulator is lower than a second switching frequency which is a switching frequency of the second switching regulator;

the first switching unit of the first switching regulator comprises a first NMOS transistor in which the first voltage is input to a source and a voltage based on the fourth voltage is input to a gate, and the motor driving module comprises a second NMOS transistor in which the voltage based on the fourth voltage is input to a gate.

2. The image forming apparatus according to claim 1, wherein the first switching regulator further comprises a first smoothing unit, wherein the first smoothing unit is configured to receive an input of a first pulse voltage which is output from the first switching unit, and is configured to output the second voltage, the first pulse voltage having an amplitude corresponding to the first voltage and the first switching frequency, the second switching regulator comprises:

a second switching unit configured to control the output of the second switching regulator; and a second smoothing unit, wherein the second smoothing unit is configured to receive an input of a second pulse voltage which is output from the second switching unit, and is configured to output the third voltage, the second pulse voltage having an amplitude corresponding to the second voltage and the second switching frequency.

3. The image forming apparatus according to claim 2, further comprising:

a first power management device; and a second power management device, wherein:

the first power management device comprises at least the first switching unit; and the second power management device comprises at least the second switching unit.

4. The image forming apparatus according to claim 3, wherein the first power management device is configured to be disposed in a first IC package, the second power management device is configured to be disposed in a second IC package, the first switching unit is configured to be disposed in the first IC package, the first smoothing unit is configured to be disposed outside the first IC package and the second IC package, the second switching unit is configured to be disposed in the second IC package, and the second smoothing unit is configured to be disposed outside the first IC package and the second IC package.

5. The image forming apparatus according to claim 3, wherein the first power management device further comprises:

a plurality of first switching regulators; and the step-up circuit, wherein, among switching elements included in the first switching units of the plurality of first switching regulators, switching elements to which a voltage based on the fourth voltage is input to a gate are NMOS transistors.

6. The image forming apparatus according to claim 3, wherein the second power management device further comprises a series regulator configured to receive the input of the second voltage and outputs a fifth voltage lower than the second voltage, and the fifth voltage is input to the central processing device.

7. The image forming apparatus according to claim 3, wherein the first smoothing unit comprises a first coil and a first capacitor, the second smoothing unit comprises a second coil and a second capacitor, the second coil has an inductance value lower than an inductance value of the first coil, the second capacitor has a capacitance value lower than a capacitance value of the first capacitor, and the second power management device is disposed at a position closer to the central processing device as compared to the first power management device.

8. The image forming apparatus according to claim 2, wherein a switching element configured to receive the input of the second voltage among switching elements which are provided in the second switching unit is a PMOS transistor in which a voltage lower than the second voltage is input to a gate.

9. The image forming apparatus according to claim 1, wherein the third voltage is supplied to a synchronous DRAM.

10. The image forming apparatus according to claim 1, wherein the motor driving module comprises an H-bridge circuit including the second NMOS transistor.

* * * * *